US011317682B2

(12) United States Patent
Poulakis

(10) Patent No.: US 11,317,682 B2
(45) Date of Patent: May 3, 2022

(54) ADHESIVE CLOSURE SYSTEM

(71) Applicant: Gottlieb Binder GmbH & Co. KG, Holzgerlingen (DE)

(72) Inventor: Konstantinos Poulakis, Hildrizhausen (DE)

(73) Assignee: GOTTLIEB BINDER GMBH & CO. KG, Holzgerlingen (DE)

( * ) Notice: Subject to any disclaimer, the term of this patent is extended or adjusted under 35 U.S.C. 154(b) by 0 days.

(21) Appl. No.: 16/769,656

(22) PCT Filed: Nov. 19, 2018

(86) PCT No.: PCT/EP2018/081720

§ 371 (c)(1),
(2) Date: Jun. 4, 2020

(87) PCT Pub. No.: WO2019/110283

PCT Pub. Date: Jun. 13, 2019

(65) Prior Publication Data

US 2021/0177105 A1 Jun. 17, 2021

(30) Foreign Application Priority Data

Dec. 6, 2017 (DE) ..... 10 2017 011 244.4

(51) Int. Cl.
*A44B 18/00* (2006.01)

(52) U.S. Cl.
CPC ..... *A44B 18/0088* (2013.01); *A44B 18/0007* (2013.01); *A44B 18/0053* (2013.01); *A44B 18/0065* (2013.01)

(58) Field of Classification Search
CPC ..... A44B 18/0088; A44B 18/0065; A44B 18/0007; A44B 18/0053
See application file for complete search history.

(56) References Cited

U.S. PATENT DOCUMENTS 4,290,174 A * 9/1981 Kalleberg ..... A44B 18/0019 24/444
5,019,065 A * 5/1991 Scripps ..... A61F 13/581 604/385.21

(Continued)

FOREIGN PATENT DOCUMENTS

DE 102 40 986 2/2004
DE 20 2006 002 409 5/2006

(Continued)

OTHER PUBLICATIONS

International Search Report (ISR) dated Jan. 30, 2019 in International (PCT) Application No. PCT/EP2018/081720.

*Primary Examiner* — David M Upchurch
(74) *Attorney, Agent, or Firm* — Wenderoth, Lind & Ponack, L.L.P

(57) ABSTRACT

A touch fastener system has two interconnectable and detachable touch fastener parts (4), each of which has a plurality of fastening elements (6) projecting from a carrier. The fastening elements (6) can be brought into detachable engagement with each other opposite from each other in a predeterminable connection area. The fastening elements (6) of the one type of a touch fastener part (4) within the connection area receive the fastening elements (20) of the other type between them forming strips (22, 24). One of the touch fastener parts (4) has fastening elements (6) of only one type, which, when engaged within the connection area, are connected to fastening elements (6) of this type and to fastening elements (20) of a further type of the respective other touch fastener part (4).

17 Claims, 3 Drawing Sheets

(56) References Cited

U.S. PATENT DOCUMENTS 5,231,738 A * 8/1993 Higashinaka ..... A44B 18/003 24/446
5,235,731 A * 8/1993 Anzai ..... A44B 18/0053 24/590.1
5,669,120 A * 9/1997 Wessels ..... A44B 18/0034 24/446
5,745,961 A * 5/1998 Okawa ..... A44B 18/0023 24/442
5,797,170 A * 8/1998 Akeno ..... A44B 18/0053 24/452
5,983,467 A * 11/1999 Duffy ..... A44B 18/0046 24/442
7,950,114 B2 * 5/2011 Duffy ..... A44B 18/0049 24/452
8,388,880 B2 * 3/2013 Tuma ..... A44B 18/0065 264/250
8,881,369 B2 * 11/2014 Kirby ..... F16M 13/027 29/592.1
9,072,343 B1 * 7/2015 Ogilvie ..... A44B 18/0034
9,655,413 B2 * 5/2017 Adams ..... A44B 18/0007
2001/0013277 A1 * 8/2001 Galkiewicz ..... A44B 18/0053 100/2
2002/0069495 A1 * 6/2002 Murasaki ..... A44B 18/0053 24/442
2003/0126724 A1 * 7/2003 Kono ..... A44B 18/0019 24/451
2003/0131453 A1 * 7/2003 Clarner ..... A44B 18/0065 24/452
2004/0117955 A1 * 6/2004 Barvosa-Carter ..... A44B 18/0003 24/442
2005/0060849 A1 * 3/2005 Vanbenschoten ..... A61F 13/625 24/451
2006/0110572 A1 * 5/2006 Herrero ..... B29C 43/222 428/100
2008/0104787 A1 * 5/2008 Keenan ..... A45D 34/04 15/210.1
2009/0013506 A1 * 1/2009 Mizuhara ..... A44B 18/0069 24/442
2009/0106954 A1 * 4/2009 Brockman ..... A44B 18/0076 24/442
2011/0271496 A1 * 11/2011 Tuma ..... A44B 18/0065 24/451
2013/0052403 A1 * 2/2013 Barker ..... A44B 18/0011 428/99
2013/0067701 A1 * 3/2013 Grady ..... A44B 18/0049 24/442
2014/0101901 A1 * 4/2014 Tuma ..... A44B 18/0088 24/446
2016/0107353 A1 * 4/2016 Poulakis ..... B29C 44/1271 24/442
2019/0308785 A1 * 10/2019 Grady ..... A44B 18/00

FOREIGN PATENT DOCUMENTS

DE 10 2012 023 920 6/2014
DE 10 2013 009 091 12/2014
EP 0 565 750 10/1993
JP 5-154009 6/1993
JP 5-154010 6/1993

* cited by examiner

ADHESIVE CLOSURE SYSTEM

FIELD OF THE INVENTION

The invention relates to a touch fastener system having two interconnectable and detachable touch fastener parts with touch fastening elements of two types projecting from their carriers. The fastening elements one type detachable engage and receive the fastening elements of the other type in a connection area.

BACKGROUND OF THE INVENTION

Touch fastener systems are state of the art and freely available in the market in a variety of forms. In widespread embodiments, the film-shaped carrier is formed by a polyamide base fabric, from which stems forming the fastening elements protrude, for example, in the form of mushroom heads or hooks formed at the ends of the stems. Those fastening elements can engage with the fastening elements on the other touch fastener part forming a counterpart. In advantageous embodiments, mushroom heads are provided on both touch fastener parts to be interconnected, which mushroom heads interlock to form a "hermaphrodite fastener". A fastener system of this type is available from the applicant under the product name Duotec®.

Touch fastener systems of this type are characterized by a high binding force, i.e. a high resistance to the mutual peeling of the touch fastener parts from each other. The closing force required to produce the hooking engagement in contrast is much lower. These advantageous properties are diminished by a lower shear strength, i.e. the force that counteracts displacements of the touch fastener parts, when lateral forces parallel to the film-shaped carrier are applied. In order to improve the relation between binding force and shear strength, it is known not to arrange fastening elements in equidistant linear rows and columns, but in special patterns. For instance, document EP 0 565 750 B1 shows a "chaotic" arrangement of mushroom-head-shaped fastening elements in sub-areas. The sub-areas of the same pattern arrangement are repeated to form a larger total area. A further solution, which is disclosed in DE 102 40 986 B3, provides for the arrangement of fastening elements along arcs having a sinusoidal course. However, the respective improvements in shear strength achieved in this way are not fully sufficient for applications of the touch fastener systems, where occurrence of displacement forces are to be expected, as is the case, for example, when used to fasten panels or covers to wall surfaces.

DE 10 2012 023 920 A1 discloses a generic touch fastener system of two interconnectable and detachable touch fastener parts, each of which has a plurality of fastening elements projecting from a carrier. The fastening elements can be brought into detachable engagement with each other opposite from each other in a predeterminable connecting area. The fastening elements of the one type of a touch fastener part receive within the connecting area the fastening elements of the other type between them, forming strips.

SUMMARY OF THE INVENTION

With regard to this difficulty, the invention addresses the problem of providing a touch fastener system of the genus mentioned at the beginning, which is characterized by a higher shear strength while maintaining a high binding force.

According to the invention, this problem is basically solved by a touch fastener system having, as an essential feature of the invention, one of the touch fastener parts has fastening elements of the one type that, when engaged within the connecting area, are connected to fastening elements of this type and to fastening elements of a further type of the respective other touch fastener part. When equipping one of the touch fastener parts with fastening elements of different types, the combination of the interacting fastening elements can be laid out such that the engagement of the fastening elements of the one type with the fastening elements of the same type on the other touch fastener part results in high binding forces. At the same time, the engagement of these fastening elements of the one type with the fastening elements of the second type on the other touch fastener part results in a high shear strength. This structure permits achieving a particularly favorable ratio between binding forces and shear strength, so that an extended range of applications can be achieved for the touch fastener system according to the invention.

The arrangement can be advantageously made in such a way that the fastening element of the respective one type is formed by a stem projecting from the assignable carrier. The free end of the stem has a mushroom-shaped head. The fastening element of the respective other type comprises a loop or sling arranged on the assignable carrier. The engaging mushroom heads of the fastening elements of the one type provide the desired high binding force. The engagement of the mushroom heads of the fastening elements of the first type with the loops or slings provides high values of shear strength.

The strips, aligned equally in length and width on the carrier, can be formed in an alternating sequence from fastening elements of the one type and of the other type. The respective strip, viewed transversely to the longitudinal direction of its carrier, can have a greater length than its width in the longitudinal direction of the carrier.

To form a type of fastening clip, the carrier can advantageously form a square section piece, which carries two strips of fastening elements of the one type and one strip of fastening elements of the other type. All fastening elements of the one type and of the other type can be geometrically identical in their respective type.

In advantageous embodiments, the fastening elements of the one type of the one touch fastener part abut on a common end plane in terms of their axial extension from the upper side of their carrier.

The fastening elements of the second type of the other touch fastener part end, starting from the upper side of their carrier, at a predeterminable distance below a common end plane, on which the free ends of the fastening elements of the one type of the other touch fastener part abut.

Advantageously, both the one and the other end plane extend in parallel to the respective assigned upper surface of the carrier and have the same perpendicular distance from their upper carrier surface.

In advantageous embodiments, the fastening elements of the one type stand uniformly in rows and columns on their carrier and are equidistant from each other such that the mushroom-shaped heads of the fastening elements of the one type of a touch fastener part engage between the fastening elements of the one type of the other touch fastener part and hook together with their mushroom-shaped heads by forming the detachable fastening.

The arrangement can be advantageously made in such a way that the fastening elements of the one type have an arc-shaped, in particular sinusoidal, set-up pattern, at least in relation to a strip.

Alternatively, the fastening elements of the one type can have at least one chaotic set-up pattern, at least in relation to one strip.

In particularly advantageous embodiments, the fastening elements of the one type are formed from a fabric, which has loops that form stem parts after having been sliced-through. The free ends of those stem parts, when heated, form the mushroom-like heads under the internal stress of their plastic material. The loop or sling shape of the fabric is retained to form the fastening elements of the other type.

Advantageously, the fabric forming the fastening elements is coated, in particular with a polyurethane coating.

The carrier, which is provided with the fastening elements of only the one type, can also be an injection-molded or extruded plastic section.

In an alternative embodiment, the respective carrier, preferably the carrier having the fastening elements of the one type and of the second type, can be formed multi-part and can have an injection-molded or extruded plastic section as a base carrier. The fabric forming the respective fastening elements is glued to the base carrier.

Preferably the respective fabric is connected to the plastic section by a liquid-crosslinking polyurethane adhesive.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1A:
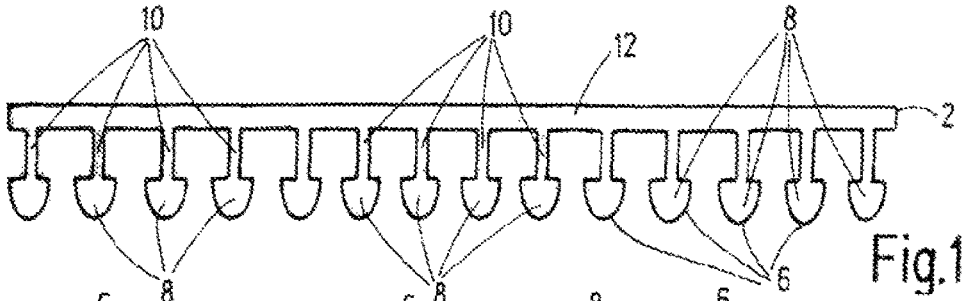
Fig.1a PRIOR ART
FIGS. 1*a* and 1*b* are schematically simplified and enlarged side views, not to scale, of a first and a second touch fastener part of the usual type for forming a touch fastener system according to the prior art.
Figure 1B:
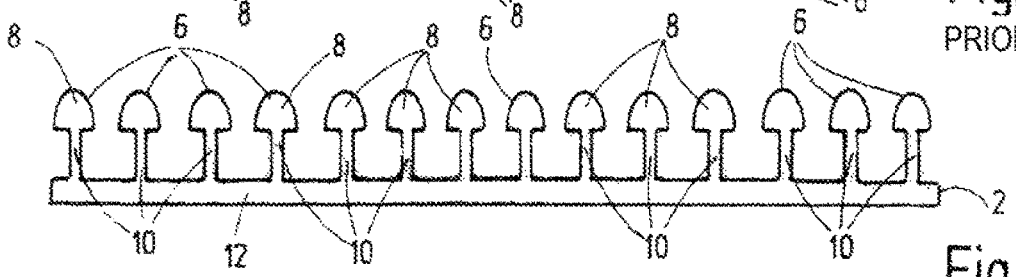
Fig.1b PRIOR ART
Figure 1C:
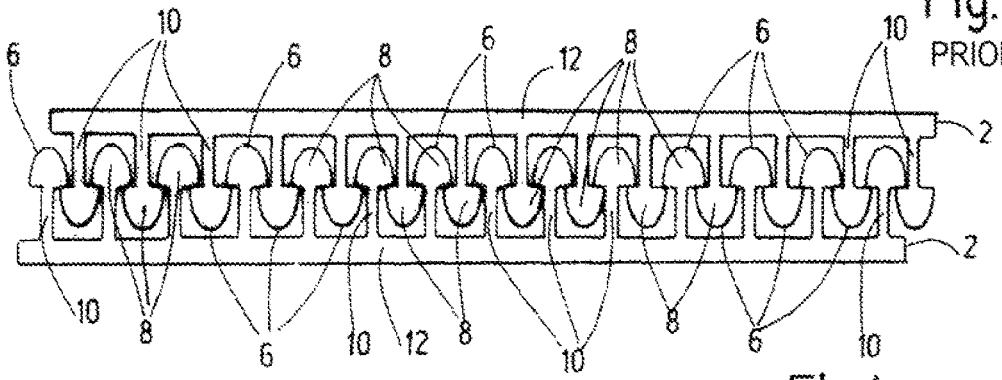
Fig.1c PRIOR ART
FIG. 1*c* is a simplified representation side view of the fastener parts of FIGS. 1*a* and 1*b* of the touch fastener system according to the state of the art engaged.

FIGS. 1*a* and 1*b* each show a state of the art or prior art touch fastener part 2, which form the active components of a conventional touch fastener system and which are provided with the same type of fastening elements 6 (only partially numbered in the figures). The fastening elements 6 are formed by mushroom heads 8, only some of which are numbered in the figures and which are located at the ends of the stems 10 protruding from a flat carrier 12. When the fastening elements 6 engage with each other, touch fastener parts 2 of this type form a mushroom-in-mushroom fastener of a state-of-the-art touch fastener system, as shown in FIG. 1*c*. Touch fastener parts 2 of this type are commercially available and can be obtained from the applicant under the product name Duotec®. A base fabric of polyamide having polypropylene stems 10 on which the mushroom heads 8 are formed by thermal processing forms the carrier 12 of the touch fastener parts 2. The carrier 12 having the fastening elements 6 can also be an injection-molded or extruded plastic section.

Figure 2:
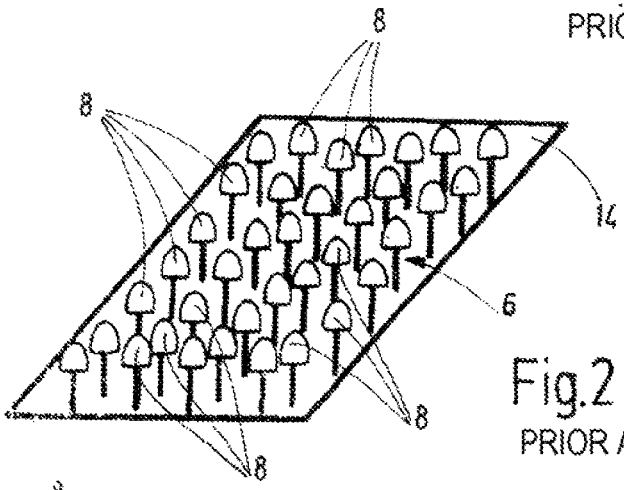
Fig.2 PRIOR ART
FIGS. 2 and 3 are sketchy and simplified perspective views, not to scale, of a surface area of two further touch fastener parts according to the prior the art.
Figure 3:
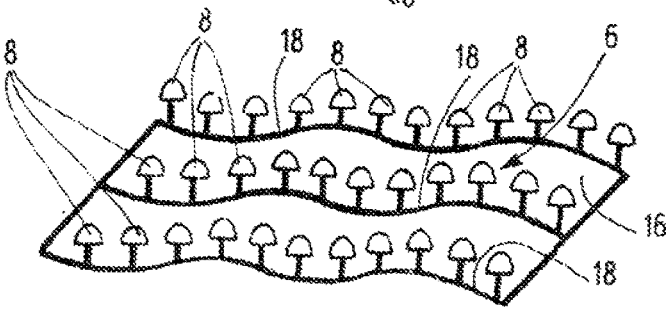
Fig.3 PRIOR ART

Touch fastener systems of this known type are characterized by a high binding force, which counteracts the disengagement by peeling the touch fastener parts 2 off each other. These known touch fastener systems also require a comparatively low closing force to produce the engagement and are therefore easy and safe to handle. However, the level of shear strength, i.e. the resistance to relative sliding motions of the touch fastener parts 2, leaves something to be desired for some applications, for instance when using the touch fastener system as the only attachment for mounting panels or covers on wall surfaces. FIG. 2 illustrates a state-of-the-art solution, where, in an effort to achieve a higher shear strength, touch fastener elements 6 are arranged at the common area of a touch fastener part 14, not in regular rows and columns, but in a special pattern, as in the chaotic arrangement shown in FIG. 2, or in an arrangement as shown in the document EP 0 565 750 B1 already mentioned. FIG. 3 illustrates a further known approach for increasing the shear strength. As shown, at the connection area of the touch fastener part 16, fastening elements 6, having mushroom heads 8, of the type shown in FIGS. 1*a* to 1*c*, are arranged along arc lines 18, which are formed in the manner of sine waves. Such an arrangement can be realized, if the fastening elements 6 are produced by heat treatment of threads of a base fabric in the manner shown in DE 102 40 986 B3. The base fabric may be provided with a polyurethane coating.

Figure 4A:
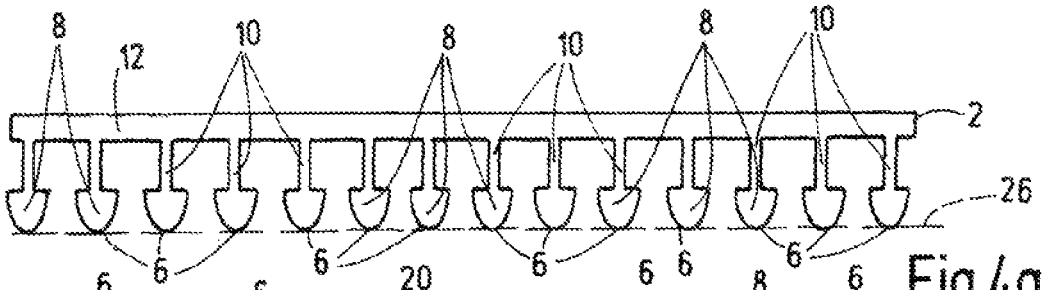
FIGS. 4*a* and 4*b* are schematically simplified and enlarged side views of first and second touch fastener parts, respectively, for forming a touch fastener system according to a first exemplary embodiment of the invention.
Figure 4B:
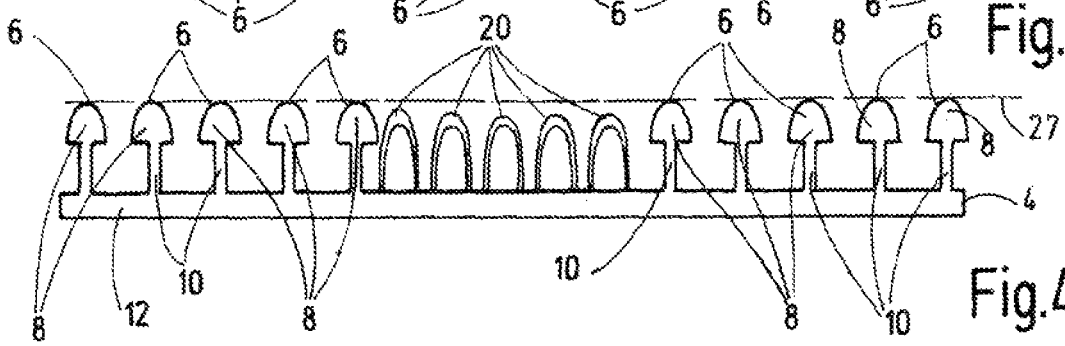
Figure 4C:
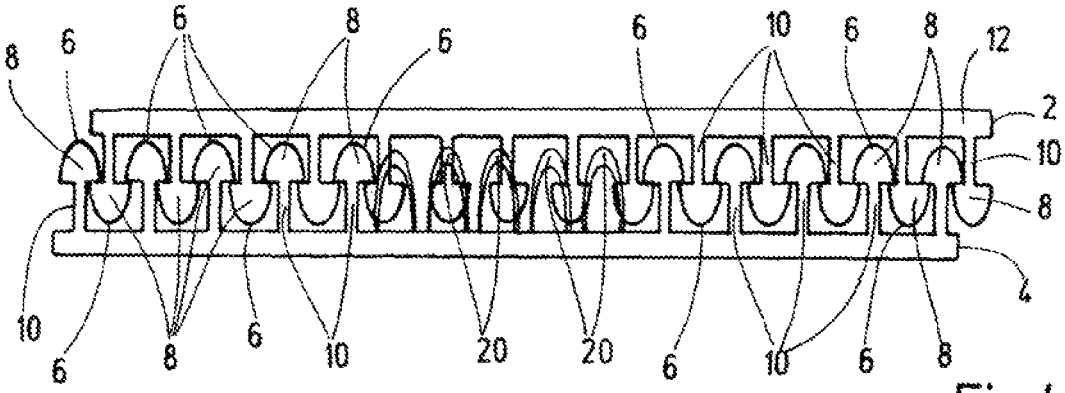
FIG. 4*c* is a schematically simplified and enlarged side view of the touch fastener system formed from the touch fastener parts of FIGS. 4*a* and 4*b* according to the first embodiment of the invention.
Figure 5:
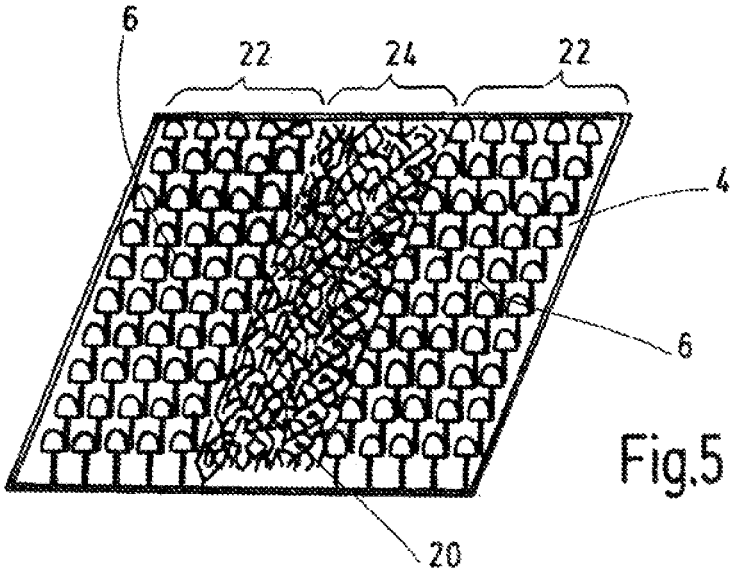
FIG. 5 is a perspective view, viewed towards the top, of a schematically simplified representation, not to scale, of the touch fastener part of FIG. 4*b*.

FIGS. 4*a*, 4*b* and 4*c* show an embodiment of the touch fastener system according to the invention. It is made of different types of touch fastener parts. The fastener part of the first type is formed by the touch fastener part 2 of a known type as shown in FIGS. 1*a* and 1*b*. Duotec® 50 elements are is provided in the embodiment. On the carrier 12 of the other touch fastener part 4, serving as a counterpart, there are fastening elements of the first type and of a second type in the connection area. The fastening elements of the first type correspond to the fastening elements 6 of the touch fastener part 2, whereas the fastening elements of the second type are formed by loops 20. As FIG. 5 shows, in which the second touch fastener part 4 is shown in top view, the fastening elements 6 of the first type are arranged on the carrier 12 in two strips 22. Between the two strips 22, the loop-shaped fastening elements 20 extend in a third strip 24. In this example, the strips 22 are each formed by a strip of Duotec® 50 elements. The middle strip 24 is formed by a strip in the form of a fleece material, such as that distributed commercially by the applicant under the product name Klettostar®. The strips 22 and 24 are each rectangular, and each have the same length and width. The length is greater than the width of the strips 22, 24. As the comparison of FIGS. 4*a*, 4*b* and 4*c* yields, the heads 8 of the fastening elements 6 of the first type end, both for the first touch fastener part 2 and for the second touch fastener part 4, each end in common end planes 26 and 27 (FIGS. 4*a*, 4*b*), spaced apart from the carrier 12. The fastening elements 20 of the second type end slightly below the plane 27 of the second touch fastener part 4.

Experiments, in which a known touch fastener system, in which both touch fastener parts are formed by Duotec® 50 elements, was compared to the system according to the invention, in which the first touch fastener part 2 is of Duotec® 50 elements and the second touch fastener part 4 is of the strip arrangement shown in FIG. 5, where two strips 22 are made of Duotec® 50 elements and one strip 24 is made of Klettostar® elements, have shown that the latter system provides an approximately 33% higher shear strength against relative displacements in parallel to the longitudinal direction of the strips 22, 24 and a more than 36% higher shear strength against displacements transverse to the longitudinal direction, compared to the known system having the same kind of touch fastener parts only made of Duotec® 50 elements.

Figure 6:
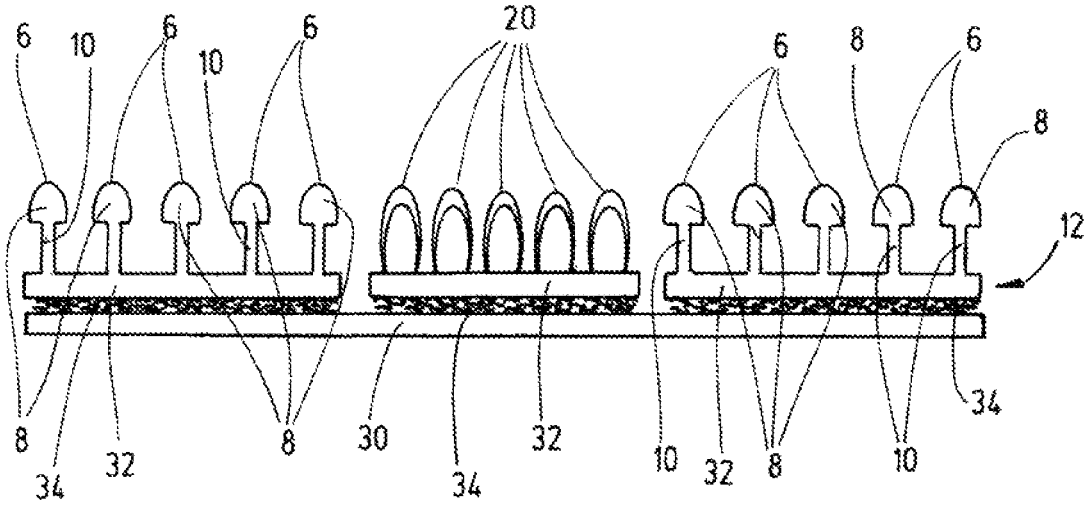
FIG. 6 is a schematically simplified side view of a second touch fastener part according to a second exemplary embodiment of the invention.

As shown in FIG. 6 using the touch fastener part 2, which has the fastening elements of the one type 6 and the fastening elements 20 of the second type, by way of example, the carrier 12 can be formed multi-part. As shown, a base carrier made of an injection-molded or extruded plastic section 30 is provided, to which the respective fabric 32, which forms the fastening elements 6, 20, is glued. Preferably the fabric 32 has a polyurethane coating on the side facing the base carrier. A moisture-crosslinking polyurethane adhesive 34 may be provided as the adhesive for forming the connection to the plastic section 30.

While various embodiments have been chosen to illustrate the invention, it will be understood by those skilled in the art that various changes and modifications can be made therein without departing from the scope of the invention as defined in the claims.

The invention claimed is:

1. A touch fastener system, comprising:

a first fastener part having a plurality of first fastening elements only projecting from a first carrier of the first fastener part in a first connection area, each of the first fastening elements having a stem projecting from the first carrier and a mushroom-shaped head on a free end of the stem thereof; and a second fastener part including a second connection area having a loop strip of plural second fastening elements with each of the second fastening elements being a loop or sling projecting from a second carrier and having first and second mushroom strips in a form of the first fastening elements projecting from the second carrier, the loop strip being between the first and second mushroom strips;

the first and second fastener parts being interconnectable and detachable when the first and second connection areas overlap with the first fastening elements of the stems and mushroom-shaped heads projecting from the first carrier of the first fastener part engaging both of the first fastening elements of the stems and the mushroom-shaped heads and the second fastening elements of the loops or slings projecting from the second carrier of the second fastener part.

2. A touch fastener system according to claim 1 wherein the loop strip and the mushroom strips are aligned equally in length and width on the second carrier and are arranged in an alternating manner.

3. A touch fastener system according to claim 1 wherein the loop strip and the first and second mushroom strips have greater lengths and widths thereof in a direction transverse to the longitudinal direction of the second carrier.

4. A touch fastener system according to claim 1 wherein the second carrier has a square surface carrying the loop strip and the first and second mushroom strips.

5. A touch fastener system according to claim 1 wherein each of the first fastening elements are identical; and each of the second fastening elements are identical.

6. A touch fastener system according to claim 1 wherein the first fastening elements on the first and second carriers end on first and second common planes, respectively, in axial extensions of the first fastening elements from respective sides of the first and second carriers, respectively.

7. A touch fastener system according to claim 6 wherein the second fastening elements extend from the second carrier to ends at a predetermined distance below the second common plane of the first fastening elements on the second carrier.

8. A touch fastener system according to claim 7 wherein the first and second common planes extend parallel to the sides of the first and second carriers, respectively, and are spaced by equal distances from the first and second carriers, respectively.

9. A touch fastener system according to claim 1 wherein the first fastening elements extend uniformly in rows and columns on the first and second carriers and are equally distant from one another on the respective carriers, such that the mushroom-shaped heads of the first fastening elements on the first carrier engage between the mushroom-shaped heads of the first fastening elements on the second carrier and hook together therewith forming a detachable fastening.

10. A touch fastener system according to claim 1 wherein the first fastening elements are formed from a first fabric having loops forming the stems after being sliced-through and then heating the free ends of to form the mushroom-shaped heads under an internal stress of plastic material of the fabric; and the second fastening elements are formed by a second fabric having loops retained.

11. A touch fastener system according to claim 10 wherein the first and second fabrics are coated.

12. A touch fastener system according to claim 10 wherein the first and second fabrics are coated with polyurethane.

13. A touch fastener system according to claim 1 wherein the first carrier is an injection-molded or extruded plastic section.

14. A touch fastener system according to claim 1 wherein the loop strip and each of the first and second mushroom strips have injection-molded or extruded plastic sections from which the first and second fastening elements extend, the plastic sections being glued to the second carrier by an adhesive.

15. A touch fastener system according to claim 14 wherein the adhesive is a crosslinking polyurethane adhesive.

16. A touch fastener system according to claim 9 wherein the second fastening elements extend uniformly on the second carrier in columns and rows equally distance from one another between the first and second mushroom strips.

17. A touch fastener system, comprising:

a first fastener part having plural mushroom-shaped fastening elements projecting from a first carrier, the mushroom-shaped fastening elements having free ends remote from the first carrier ending in a first common plane parallel to the first carrier; and a second fastener part having first and second groups of plural mushroom-shaped fastening elements projecting from a second carrier with free ends remote from the second carrier ending in a second common plane parallel to the second carrier and having plural loop-shaped fastening elements between the first and second groups of plural mushroom-shaped fastening elements, the loop-shaped fastening elements having free ends remote from the second carrier located between the second carrier and the second common plane, the first and second fastener parts being interconnectable and detachable when the mushroom-shaped fastening elements projecting from the first carrier of the first fastener part engage both the mushroom-shaped fastening elements and the loop-shaped fastening elements projecting from the second carrier of the second fastener part.

* * * * *